US011842719B2

(12) United States Patent
Blaauw et al.

(10) Patent No.: US 11,842,719 B2
(45) Date of Patent: Dec. 12, 2023

(54) SOUND PROCESSING METHOD, SOUND PROCESSING APPARATUS, AND RECORDING MEDIUM

(71) Applicant: YAMAHA CORPORATION, Hamamatsu (JP)

(72) Inventors: Merlijn Blaauw, Barcelona (ES); Jordi Bonada, Barcelona (ES); Ryunosuke Daido, Hamamatsu (JP); Yuji Hisaminato, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 492 days.

(21) Appl. No.: 17/027,058

(22) Filed: Sep. 21, 2020

(65) Prior Publication Data

US 2021/0005176 A1 Jan. 7, 2021

Related U.S. Application Data

(63) Continuation of application No. PCT/JP2019/010770, filed on Mar. 15, 2019.

(30) Foreign Application Priority Data

Mar. 22, 2018 (JP) ..... 2018-054989

(51) Int. Cl.
*G10L 13/033* (2013.01)
*G10L 21/013* (2013.01)

(52) U.S. Cl.
CPC ..... *G10L 13/0335* (2013.01); *G10L 21/013* (2013.01)

(58) Field of Classification Search
CPC ..... G10L 13/0335; G10L 21/013
See application file for complete search history.

(56) References Cited

U.S. PATENT DOCUMENTS 6,336,092 B1 * 1/2002 Gibson ..... G10H 1/366 704/207
2007/0084331 A1 * 4/2007 Haken ..... G10H 1/44 84/600

(Continued)

FOREIGN PATENT DOCUMENTS

JP 2017041213 A 2/2017
WO 9849670 A1 11/1998

(Continued)

OTHER PUBLICATIONS

Extended European Search Report issued in European Appln. No. 19772599.7 dated Nov. 15, 2021.

(Continued)

*Primary Examiner* — Anne L Thomas-Homescu
(74) *Attorney, Agent, or Firm* — ROSSI, KIMMS & McDOWELL LLP

(57) ABSTRACT

A sound processing method obtains note data representative of a note; obtains an audio signal to be processed; specifies, in accordance with the note, an expression sample representative of a sound expression to be imparted to the note and an expression period, of the audio signal, to which the sound expression is to be imparted to the note; and specifies, in accordance with the expression sample and the expression period, a processing parameter relating to an expression imparting processing for imparting the sound expression to a portion corresponding to the expression period in the audio signal. The method then generates a processed audio signal by performing the expression imparting processing in accordance with the expression sample, the expression period, and the processing parameter to the audio signal.

13 Claims, 4 Drawing Sheets

(56) References Cited

U.S. PATENT DOCUMENTS

| | | | | |
|---|---|---|---|---|
| 2008/0201150 | A1* | 8/2008 | Tamura | G10L 21/00 704/E21.001 |
| 2010/0070283 | A1 | 3/2010 | Kato | |
| 2011/0219940 | A1* | 9/2011 | Jiang | G10H 1/366 84/622 |
| 2014/0088968 | A1* | 3/2014 | Chen | G10L 13/04 704/254 |
| 2018/0166064 | A1 | 6/2018 | Saino | |

FOREIGN PATENT DOCUMENTS

| | | | | |
|---|---|---|---|---|
| WO | WO-9849670 | A1 * | 11/1998 | G10H 1/366 |
| WO | 2009044525 | A1 | 4/2009 | |
| WO | WO-2009044525 | A1 * | 4/2009 | G10L 21/02 |

OTHER PUBLICATIONS

International Search Report issued in Intl. Appln. No. PCT/JP2019/010770 dated Jun. 11, 2019. English translation provided.

Written Opinion issued in Intl. Appln. No. PCT/JP2019/010770 dated Jun. 11, 2019.

Kobayashi. "Statistical Singing Voice Converstion with Direct Waveform Modification based on the Spectrum Differential." INTERSPEECH. Sep. 14-18, 2014: 2514-2518. Cited in NPL 1 and NPL 2.

Office Action issued in Chinese Appln. No. 201980018441.5, dated Aug. 1, 2023. English machine translation provided.

* cited by examiner

SOUND PROCESSING METHOD, SOUND PROCESSING APPARATUS, AND RECORDING MEDIUM

CROSS REFERENCE TO RELATED APPLICATIONS

This application is a Continuation Application of PCT Application No. PCT/JP2019/010770, filed Mar. 15, 2019, and is based on and claims priority from Japanese Patent Application No. 2018-054989, filed Mar. 22, 2018, the entire contents of each of which are incorporated herein by reference.

BACKGROUND

Technical Field

The present disclosure relates to a technique for imparting expressions to audio such as singing voices.

Background Information

There have been proposed various conventional techniques for imparting voice expressions such as singing expressions to voices. For example, Japanese Patent Application Laid-Open Publication No. 2017-41213 (hereafter, Patent Document 1) discloses a technique for generating a voice signal representative of a voice with various voice expressions. A user selects voice expressions for impartation to a voice represented by a voice signal from candidate voice expressions. Parameters for imparting voice expressions are adjusted in accordance with instructions provided by a user.

Expertise on voice expressions is required to properly select voice expressions from candidate voice expressions for impartation to a voice and to adjust parameters that relate to the impartation of the voice expressions. Even for an expert user, selection and adjustment of voice expressions are complex tasks.

SUMMARY

Taking into account the above circumstances, an object of a preferred aspect of the present disclosure is to generate natural-sounding voices with voice expressions appropriately imparted thereto, without need for expertise on voice expressions or carrying out complex tasks.

In one aspect, a sound processing method obtains note data representative of a note; obtains an audio signal to be processed; specifies, in accordance with the note, an expression sample representative of a sound expression to be imparted to the note and an expression period, of the audio signal, to which the sound expression is to be imparted to the note; specifies, in accordance with the expression sample and the expression period, a processing parameter relating to an expression imparting processing for imparting the sound expression to a portion corresponding to the expression period of the audio signal; and generates a processed audio signal by performing the expression imparting processing in accordance with the expression sample, the expression period, and the processing parameter to the audio signal.

In another aspect, a sound processing method obtains note data representative of a note; obtains an audio signal to be processed; obtains an expression sample representative of a sound expression; obtains an expression period, of the audio signal, to which the sound expression is to be imparted; specifies, in accordance with (i) the expression sample to be imparted to the note and (ii) the expression period to which the sound expression is to be imparted to the note, a processing parameter relating to an expression imparting processing for imparting the sound expression to a portion corresponding to the expression period of the audio signal; and generates a processed audio signal by performing the expression imparting processing in accordance with the processing parameter to the audio signal.

In still another aspect, a sound processing apparatus includes a memory storing instructions; at least one processor that implements the instructions to: obtain note data representative of a note; obtain an audio signal to be processed; specify, in accordance with the note, an expression sample representative of a sound expression to be imparted to the note and an expression period, of the audio signal, to which the sound expression is to be imparted to the note; specify, in accordance with the expression sample and the expression period, a processing parameter relating to an expression imparting processing for imparting the sound expression to a portion corresponding to the expression period of the audio signal; and generate a processed audio signal by performing the expression imparting processing in accordance with the expression sample, the expression period, and the processing parameter to the audio signal.

In still yet another aspect, a sound processing apparatus includes a memory storing instructions; and at least one processor that implements the instructions to: obtain note data representative of a note; obtain an audio signal to be processed; obtain an expression sample representative of a sound expression; obtain an expression period, of the audio signal, to which the sound expression is to be imparted; specify, in accordance with (i) an expression sample to be imparted to the note and (ii) the expression period to which the sound expression is to be imparted to the note, a processing parameter relating to an expression imparting processing for imparting the sound expression to a portion corresponding to the expression period of the audio signal; and generate a processed audio signal by performing the expression imparting processing in accordance with the processing parameter to the audio signal.

In another aspect, a non-transitory computer-readable recording medium stores a program executable by a computer to execute a sound processing method comprising: obtaining note data representative of a note; obtaining an audio signal to be processed; specifying, in accordance with the note, an expression sample representative of a sound expression to be imparted to the note and an expression period, of the audio signal, to which the sound expression is to be imparted to the note; specifying, in accordance with the expression sample and the expression period, a processing parameter relating to an expression imparting processing for imparting the sound expression to a portion corresponding to the expression period of the audio signal; and generating a processed audio signal by performing the expression imparting processing in accordance with the expression sample, the expression period, and the processing parameter to the audio signal.

DETAILED DESCRIPTION

Figure 1:
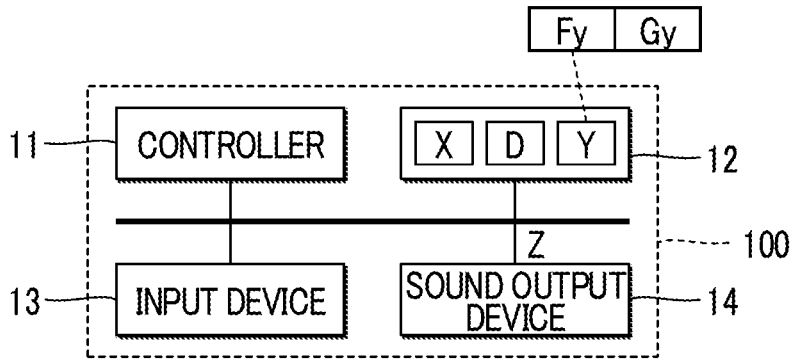
FIG. 1 is a block diagram showing a configuration of an information processing apparatus according to an embodiment of the present disclosure.

FIG. 1 is a block diagram showing a configuration of an information processing apparatus 100 according to a preferred embodiment of the present disclosure. The information processing apparatus 100 of the present embodiment is a voice processing apparatus that imparts various voice expressions to a singing voice produced by singing a song (hereafter, "singing voice"). The voice expressions are sound characteristics imparted to a singing voice. In singing a song, voice expressions are musical expressions that relate to vocalization (i.e., singing). Specifically, preferred examples of the voice expressions are singing expressions, such as vocal fry, growl, or huskiness. The voice expressions are, in other words, singing voice features.

There is a tendency for voice expressions to be prominent during attack and release in vocalization. Attack occurs at the beginning of vocalization, and release occurs at the end of the vocalization. Taking into account these tendencies, in the present embodiment, voice expressions are imparted to each of attack and release portions of the singing voice. In this way, it is possible to add voice expressions to a singing voice at positions that accord with natural voice-expression tendencies. In the attack portion, a volume increases just after singing starts, while in the release portion, a volume decreases just before the singing ends.

As illustrated in FIG. 1, the information processing apparatus 100 is realized by a computer system that includes a controller 11, a storage device 12, an input device 13, and a sound output device 14. For example, a portable information terminal such as a mobile phone or a smartphone, or a portable or stationary information terminal such as a personal computer is preferable for use as the information processing apparatus 100. The input device 13 receives instructions provided by a user. Specifically, operators that are operable by the user or a touch panel that detects contact thereon by the user are preferable for use as the input device 13.

The controller 11 is, for example, at least one processor, such as a CPU (Central Processing Unit), which controls a variety of computation processing and control processing. The controller 11 of the present embodiment generates a voice signal Z. The voice signal Z is representative of a voice (hereafter, "processed voice") obtained by imparting voice expressions to a singing voice. The sound output device 14 is, for example, a loudspeaker or a headphone, and outputs a processed voice that is represented by the voice signal Z generated by the controller 11. A digital-to-analog converter converts the voice signal Z generated by the controller 11 from a digital signal to an analog signal. For convenience, illustration of the digital-to-analog converter is omitted. Although the sound output device 14 is mounted to the information processing apparatus 100 in the configuration shown in FIG. 1, the sound output device 14 may be provided separate from the information processing apparatus 100 and connected thereto either by wire or wirelessly.

The storage device 12 is a memory constituted, for example, of a known recording medium, such as a magnetic recording medium or a semiconductor recording medium, and has stored therein a computer program to be executed by the controller 11 (i.e., a sequence of instructions for a processor) and various types of data used by the controller 11. The storage device 12 may be constituted of a combination of different types of recording media. The storage device 12 (for example, cloud storage) may be provided separate from the information processing apparatus 100 with the controller 11 configured to write to and read from the storage device 12 via a communication network, such as a mobile communication network or the Internet. That is, the storage device 12 may be omitted from the information processing apparatus 100.

The storage device 12 of the present embodiment has stored therein voice signals X, song data D, and expression samples Y. A voice signal X is an audio signal representative of a singing voice produced by singing a song. The song data D is a music file indicative of a series of notes constituting a song represented by the singing voice. That is, the song in the voice signal X is the same as that in the song data D. Specifically, the song data D designates a pitch, a duration, and intensity for each of the notes of the song. Preferably, the song data D is a file (standard MIDI File (SMF)) that complies with the MIDI (Musical Instrument Digital Interface) standard.

The voice signal X may be generated by recording singing by a user. A voice signal X transmitted from a distribution apparatus may be stored in the storage device 12. The song data D is generated by analyzing the voice signal X. However, a method for generating the voice signal X and the song data D is not limited to the above examples. For example, the song data D may be edited in accordance with instructions provided by a user to the input device 13, and the edited song data D may then be used to generate a voice signal X by use of known voice synthesis processing. Song data D transmitted from a distribution apparatus may be used to generate a voice signal X.

Each of the expression samples Y constitutes data representative of a voice expression to be imparted to a singing voice. Specifically, each expression sample Y represents sound characteristics of a singing voice sung with voice expressions (hereafter, "reference voice"). The different expression samples Y have the same type of voice expression (i.e., a classification, such as growl or huskiness, is the same for the different expression samples Y), but temporal changes in volume, duration, or other characteristics differ for each of the expression samples Y. The expression samples Y include those for attack and release portions of a reference voice. Multiple sets of expression samples Y may be stored in the storage device 12 for a variety of types of voice expressions, and a set of expression samples Y that corresponds to one selected by a user from among the difference types of voice expressions may then be selectively used from among the multiple sets of expression samples Y.

The information processing apparatus 100 according to the present embodiment generates a voice signal Z of a processed voice in which the phonemes and pitches of a singing voice represented by the voice signal X are maintained, by imparting to the singing voice expressions of a reference voice represented by expression samples Y. A singer of a singing voice and that of a reference voice are usually different, but they may be the same. For example, a singing voice may be a voice sung by a user with voice expressions, and a reference voice may be a voice sung by the user without voice expressions.

Figure 2:
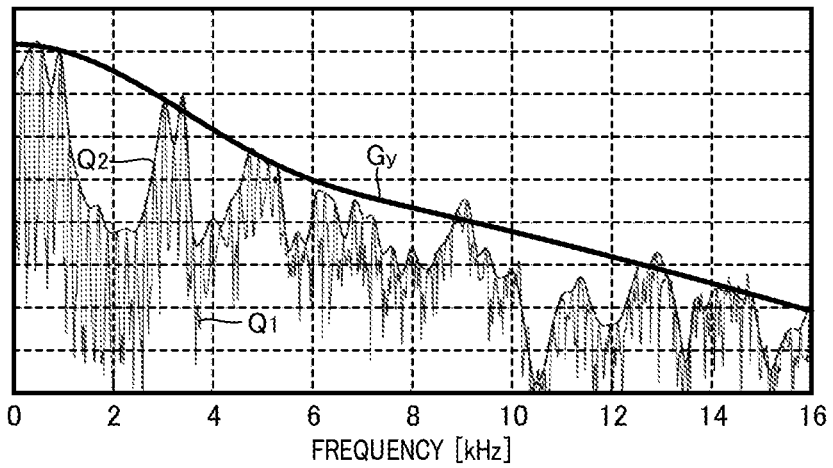
FIG. 2 is an explanatory diagram of a spectrum envelope contour.

As illustrated in FIG. 1, each expression sample Y consists of a series of fundamental frequencies Fy and a series of spectrum envelope contours Gy. As shown in FIG. 2, the spectrum envelope contour Gy denotes an intensity distribution obtained by smoothing in a frequency domain a spectrum envelope Q2 that is a contour of a frequency spectrum Q1 of a reference voice. Specifically, the spectrum envelope contour Gy is a representation of an intensity distribution obtained by smoothing the spectrum envelope Q2 to an extent that phonemic features (phoneme-dependent differences) and individual features (differences dependent on a person who produces a sound) can no longer be perceived. The spectrum envelope contour Gy may be expressed in the form of a predetermined number of lower-order coefficients of plural Mel Cepstrum coefficients representative of the spectrum envelope Q2. Although the above description focuses on the spectrum envelope contour Gy of an expression sample Y, the same is true for the spectrum envelope contour Gx of the voice signal X representative of a singing voice.

Figure 3:
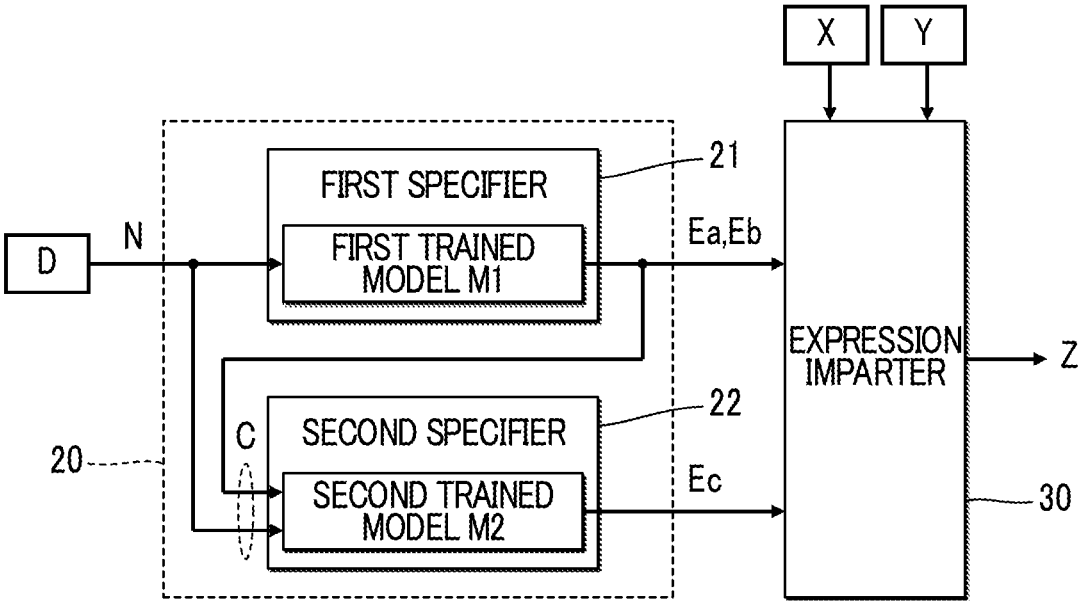
FIG. 3 is a block diagram showing a functional configuration of the information processing apparatus.

FIG. 3 is a block diagram showing a functional configuration of the controller 11. As shown in FIG. 3, the controller 11 executes a computer program stored in the storage device 12, to realize functions (a specifying processor 20 and an expression imparter 30) to generate a voice signal Z. The functions of the controller 11 may be realized by multiple apparatuses provided separately. A part or all of the functions of the controller 11 may be realized by dedicated electronic circuitry.

Expression Imparter 30

Figure 4:
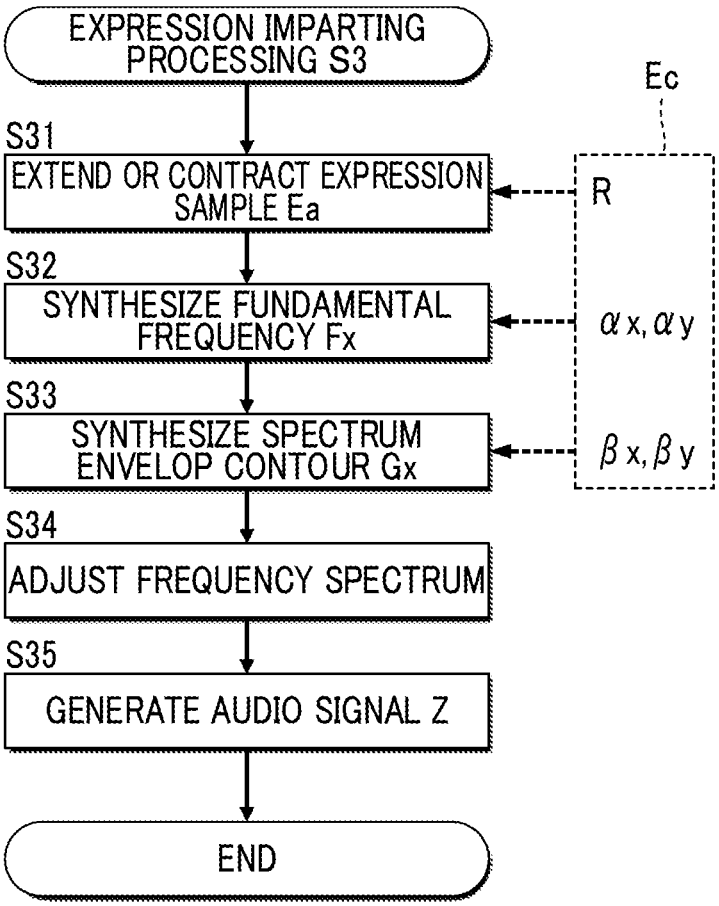
FIG. 4 is a flowchart showing an example of a specific procedure of expression imparting processing.

The expression imparter 30 executes a process of imparting voice expressions ("expression imparting processing") S3 to a singing voice of a voice signal X stored in the storage device 12. A voice signal Z representative of the processed voice is generated by carrying out the expression imparting processing S3 on the voice signal X. FIG. 4 is a flowchart showing an example of a specific procedure of the expression imparting processing S3, and FIG. 5 is an explanatory diagram of the expression imparting processing S3.

Figure 5:
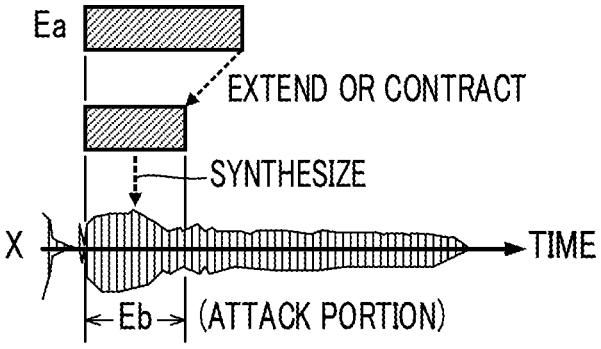
FIG. 5 is an explanatory diagram of the expression imparting processing.

As shown in FIG. 5, an expression sample Ea selected from the expression samples Y stored in the storage device 12 is imparted to one or more periods (hereafter, "expression period") Eb of the voice signal X. The expression period Eb is a period that corresponds to an attack or a release portion within a vocal period of each of the notes designated by the song data D. FIG. 5 shows an example in which an expression sample Ea is imparted to an attack portion of the voice signal X.

As shown in FIG. 4, the expression imparter 30 extends or contracts the expression sample Ea selected from the expression samples Y according to an extension or contraction rate R that is determined based on the expression period Eb (S31). The expression imparter 30 transforms a portion that corresponds to the expression period Eb within the voice signal X in accordance with the extended or contracted expression sample Ea (S32, S33). The voice signal X is transformed for each expression period Eb. Specifically, the expression imparter 30 synthesizes fundamental frequencies (S32) and then synthesizes spectrum envelope contours (S33) between the voice signal X and the expression sample Ea, which will be described below in detail. The synthesis of fundamental frequencies (S32) and the synthesis of spectrum envelope contours (S33) may be performed in reverse order.

Synthesis of Fundamental Frequencies (S32)

The expression imparter 30 calculates a fundamental frequency F(t) at each time t within the expression period Eb in the voice signal Z, by computation of the following Equation (1).

$$F(t)=Fx(t)-\alpha x(Fx(t)-fx(t))+\alpha y(Fy(t)-fy(t)) \quad (1)$$

The fundamental frequency Fx(t) in Equation (1) is a fundamental frequency (pitch) of the voice signal X at a time t on a time axis. The reference frequency fx(t) is a frequency at the time t when a series of fundamental frequencies Fx(t) is smoothed on a time axis. The fundamental frequency Fy(t) in Equation (1) is a fundamental frequency Fy at the time t in the extended or contracted expression sample Ea. The reference frequency fy(t) is a frequency at the time t when a series of fundamental frequencies Fy(t) is smoothed on a time axis. The coefficients ax and ay in Equation (1) are set each to a non-negative value equal to or less than 1 ($0 \le \alpha x \le 1$, $0 \le \alpha y \le 1$).

As will be understood from Equation (1), the second term of Equation (1) corresponds to a process of subtracting, from the fundamental frequency Fx(t) of the voice signal X, a difference between the fundamental frequency Fx(t) and the reference frequency fx(t) of the singing voice with a degree that accords with the coefficient $\alpha x$. The third term of Equation (1) corresponds to a process of adding to the fundamental frequency Fx(t) of the expression sample Ea a difference between the fundamental frequency Fy(t) and the reference fundamental frequency fy(t) of the reference voice with a degree that accords with the coefficient $\alpha y$. As will be understood from the above explanations, the expression imparter 30 replaces the difference between the fundamental frequency Fx(t) and the reference frequency fx(t) of the singing voice by the difference between the fundamental frequency Fy(t) and the reference frequency fy(t) of the reference voice. Accordingly, a temporal change in the fundamental frequency Fx(t) in the expression period Eb of the voice signal X approaches a temporal change in the fundamental frequency Fy(t) in the expression sample Ea.

Synthesis of Spectrum Envelope Contours (S33)

The expression imparter 30 calculates a spectrum envelope contour G(t) at each time t within the expression period Eb in the voice signal Z, by computation of the following Equation (2).

$$G(t)=Gx(t)-\beta x(Gx(t)-gx)+\beta y(Gy(t)-gy) \quad (2)$$

The spectrum envelope contour Gx(t) in Equation (2) is a contour of a spectrum envelope of the voice signal X at a time t on a time axis. The reference spectrum envelope contour gx is a spectrum envelope contour Gx(t) at a specific time point within the expression period Eb in the voice signal X. A spectrum envelope contour Gx(t) at an end (e.g., a start point or an end point) of the expression period Eb may be used as the reference spectrum envelope contour gx. A representative value (e.g., an average) of the spectrum envelope contours Gx(t) in the expression period Eb may be used as the reference spectrum envelope contour gx.

The spectrum envelope contour Gy(t) in Equation (2) is a spectrum envelope contour Gy of the expression sample Ea at a time point t on a time axis. The reference spectrum envelope contour gy is a spectrum envelope contour Gy(t) of the voice signal X at a specific time point within the expression period Eb. A spectrum envelope contour Gy(t) at an end (e.g., a start point or an end point) of the expression period Ea may be used as the reference spectrum envelope contour gy. A representative value (e.g., an average) of the spectrum envelope contours Gy(t) in the expression period Ea may be used as the reference spectrum envelope contour gy.

The coefficients $\beta x$ and $\beta y$ in Equation (2) are each set to a non-negative value equal to or less than 1 ($0 \le \beta x \le 1$, $0 \leq \beta y \leq 1$). The second term of Equation (2) corresponds to a process of subtracting, from the spectrum envelope contour Gx(t) of the voice signal X, a difference between the spectrum envelope contour Gx(t) and the reference spectrum envelope contour gx of the singing voice with a degree that accords with the coefficient βx. The third term of Equation (2) corresponds to a process of adding, to the spectrum envelope contour Gx(t) of the expression sample Ea, a difference between the spectrum envelope contour Gy(t) and the reference spectrum envelope contour gy of the reference voice with a degree that accords with the coefficient βy. As will be understood from the above explanations, the expression imparter 30 replaces the difference between the spectrum envelope contour Gx(t) and the reference spectrum envelope contour gx of the singing voice by the difference between the spectrum envelope contour Gy(t) and the reference spectrum envelope contour gy of the expression sample Ea.

The expression imparter 30 generates the voice signal Z representative of the processed voice, using the results of the above processing (i.e., the fundamental frequency F(t) and the spectrum envelope contour G(t)) (S34). Specifically, the expression imparter 30 adjusts each frequency spectrum of the voice signal X to be aligned with the spectrum envelope contour G(t) in Equation (2) and adjusts the fundamental frequency Fx(t) of the voice signal X to match the fundamental frequency F(t). The frequency spectrum and the fundamental frequency Fx(t) of the voice signal X are adjusted, for example, in the frequency domain. The expression imparter 30 generates the voice signal Z by converting the frequency spectrum into a time domain (S35).

As illustrated, in the expression imparting processing S3, a series of fundamental frequencies Fx(t) in the expression period Eb in the voice signal X is changed in accordance with a series of fundamental frequencies Fy(t) in the expression sample Ea and the coefficients ax and ay. Further, in the expression imparting processing S3, a series of spectrum envelope contours Gx(t) in the expression period Eb in the voice signal X is changed in accordance with a series of spectrum envelope contours Gy(t) in the expression sample Ea and the coefficients βx and βy. The description above specifies the procedure of the expression imparting processing S3.

Specifying Processor 20

The specifying processor 20 in FIG. 3 specifies an expression sample Ea, an expression period Eb, and processing parameters Ec for each of some notes designated by the song data D. Specifically, an expression sample Ea, an expression period Eb, and processing parameters Ec are specified for each of notes to which voice expressions should be imparted from among the notes designated by the song data D. The processing parameters Ec relate to the expression imparting processing S3. Specifically, the processing parameters Ec include, as shown in FIG. 4, an extension or contraction rate R applied to extension or contraction of an expression sample Ea (S31), coefficients ax and ay applied in adjusting a fundamental frequency Fx(t) (S32), and coefficients βx and βy applied in adjusting a spectrum envelope contour Gx(t) (S33).

As shown in FIG. 3, the specifying processor 20 of the present embodiment has a first specifier 21 and a second specifier 22. The first specifier 21 specifies an expression sample Ea and an expression period Eb according to note data N representative of each note designated by the song data D. Specifically, the first specifier 21 outputs identification information indicative of an expression sample Ea and time data representative of a point in time corresponding to at least one of a start point or an end point of the expression period Eb. The note data N represents a context of each one of the notes constituting a song represented by the song data D. Specifically, the note data N designate information about each note itself (a pitch, duration, and intensity) and information on relations of the note with other notes (e.g., a duration of an unvoiced period that precedes or follows the note, a difference in pitch between the note and a preceding note, and a difference in pitch between the note and a following note). The controller 11 generates note data N for each of the notes by analyzing the song data D.

The first specifier 21 of the present embodiment determines whether to add one or more voice expressions to each note designated by the note data N, and then specifies an expression sample Ea and an expression period Eb for each note to which it is determined to add voice expressions. The note data N, which is supplied to the specifying processor 20, may designate information on each note itself (a pitch, duration, and intensity) only. The information on relations of each note with other notes are generated from the information on the note, and the generated information on relations of the note with the other notes is supplied to the first specifier 21 and the second specifier 22.

The second specifier 22 specifies in accordance with control data C processing parameters Ec for each note to which voice expressions are imparted. The control data C represent results of specification by the first specifier 21 (an expression sample Ea and an expression period Eb). The control data C according the present embodiment contain data representative of an expression sample Ea and an expression period Eb specified by the first specifier 21 for one note, and note data N of the note. The expression sample Ea and the expression period Eb specified by the first specifier 21 and the processing parameters Ec specified by the second specifier 22 are applied to the expression imparting processing S3 by the expression imparter 30, which processing is described above. It is of note that in a configuration in which the first specifier 21 outputs time data that represents only one of a start or an end point of the expression period Eb, the second specifier 22 may specify a difference in time between the start and end points (i.e., duration) of the expression period Eb as one of the processing parameters Ec.

The specifying processor 20 specifies information using trained models (M1 and M2). Specifically, the first specifier 21 inputs note data N of each note to a first trained model M1, to specify an expression sample Ea and an expression period Eb. The second specifier 22 inputs to a second trained model M2 control data C of each note to which voice expressions are imparted, to specify the processing parameters Ec.

The first trained model M1 and the second trained model M2 are predictive statistical models generated by machine learning. Specifically, the first trained model M1 is a model with learned relations between (i) note data N and (ii) expression samples Ea and expression periods Eb. The second trained model M2 is a model with learned relations between control data C and processing parameters Ec. Preferably, the first trained model M1 and the second trained model M2 are each a predictive statistical model such as a neural network. The first trained model M1 and the second trained model M2 are each realized by a combination of a computer program (for example, a program module constituting artificial-intelligence software) that causes the controller 11 to perform an operation to generate output B based on input A, and coefficients that are applied to the operation. The coefficients are determined by machine learning (in particular, deep learning) using voluminous teacher data and are retained in the storage device 12.

A neural network that constitutes each of the first trained model M1 and the second trained model M2 may be one of various models, such as a CNN (Convolutional Neural Network) or an RNN (Recurrent Neural Network). A neural network may include an additional element, such as an LSTM (Long short-term memory) or an ATTENTION. At least one of the first trained model M1 or the second trained model may be a predictive statistical model other than the neural networks such as described above. For example, one of various models, such as a decision tree or a hidden Marcov model, may be used.

The first trained model M1 outputs an expression sample Ea and an expression period Eb according to the note data N as input data. The first trained model M1 is generated by machine learning using teacher data in which (i) the note data N and (ii) an expression sample Ea and an expression period Eb are associated. Specifically, the coefficients of the first trained model M1 are determined by repeatedly adjusting each of the coefficients such that a difference (i.e., loss function) between, (i) an expression sample Ea and an expression period Eb that are output from a model with a provisional structure and provisional coefficients in response to an input of note data N contained in a portion of teacher data, and (ii) an expression sample Ea and an expression period Eb designated in the portion of teacher data, is reduced (ideally minimized) for different portions of the teacher data. It is of note that nodes with smaller coefficients may be omitted, so as to simplify a structure of the model. By the machine learning described above, the first trained model M1 specifies an expression sample Ea and an expression period Eb that are statistically adequate for unknown note data N with potential relations existing between (i) the note data N and (ii) the expression samples Ea and the expression periods Eb in the teacher data. Thus, an expression sample Ea and an expression period Eb that suit a context of a note designated by the input note data N are specified.

The teacher data used for training the first trained model M1 include portions in which the note data N are associated with data that indicate that no voice expressions are to be imparted, instead of the note data N being associated with an expression sample Ea or an expression period Eb. Therefore, in response to an input of the note data N for each note, the first trained model M1 may output a result that no voice expressions are imparted to the note; for example, no voice expressions are imparted for a note that has a sound of short duration.

The second trained model M2 outputs processing parameters Ec according to, as input data, (i) control data C that include results of specification by the first specifier 21 and (ii) note data N. The second trained model M2 is generated by machine learning using teacher data in which control data C and processing parameters Ec are associated. Specifically, the coefficients of the second trained model M2 are determined by repeatedly adjusting each of the coefficients such that a difference (i.e., loss function) between, (i) processing parameters Ec that are output from a model with a provisional structure and provisional coefficients in response to an input of control data C contained in a portion of the teacher data, and (ii) processing parameters Ec designated in the portion of teacher data, is reduced (ideally minimized) for different portions of the teacher data. It is of note that nodes with smaller coefficients may be omitted, so as to simplify a structure of the model. By the machine learning described above, the second trained model M2 specifies processing parameters Ec that are statistically adequate for unknown control data C (an expression sample Ea, an expression period Eb, and note data N) with potential relations existing between the control data C and the processing parameters Ec in the teacher data. Thus, for each expression period Eb to which to add voice expressions, processing parameters Ec that suit both an expression sample Ea to be imparted to the expression period Eb and a context of a note to which the expression period Eb belongs are specified.

Figure 6:
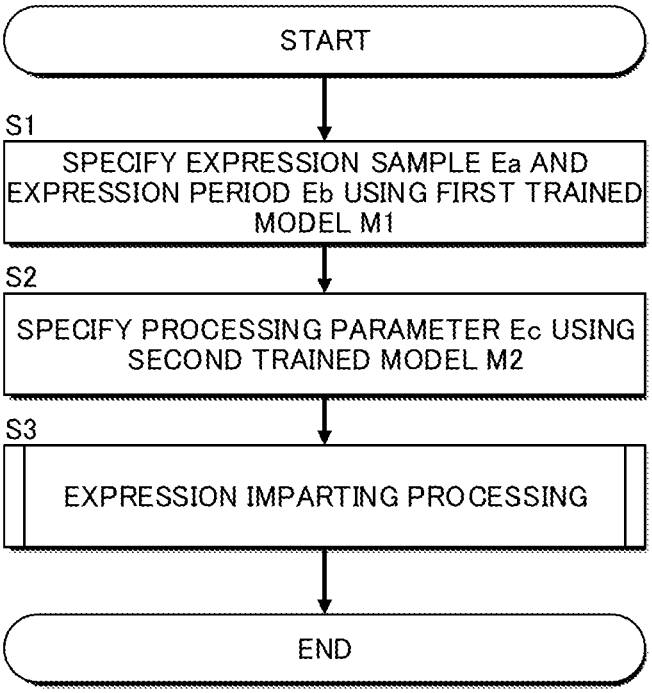
FIG. 6 is a flowchart showing a flow of an example operation of the information processing apparatus.

FIG. 6 is a flowchart showing a specific procedure of an operation of the information processing apparatus 100. The processing shown in FIG. 6 is initiated, for example, by an operation made by the user to the input device 13. The processing shown in FIG. 6 is executed for each of the notes sequentially designated by the song data D.

Upon start of the processing shown in FIG. 6, the specifying processor 20 specifies an expression sample Ea, an expression period Eb, and a processing parameter Ec according to the note data N for each note (S1, S2). Specifically, the first specifier 21 specifies an expression sample Ea and an expression period Eb according to the note data N (S1). The second specifier 22 specifies processing parameters Ec according to the control data C (S2). The expression imparter 30 generates a voice signal Z representative of a processed voice by the expression imparting processing in which the expression sample Ea, the expression period Eb, and the processing parameters Ec specified by the specifying processor 20 are applied (S3). The specific procedure of the expression imparting processing S3 is as set out earlier in the description. The voice signal Z generated by the expression imparter 30 is supplied to the sound output device 14, whereby the sound of the processed voice is output.

In the present embodiment, since an expression sample Ea, an expression period Eb and processing parameters Ec are each specified in accordance with the note data N, there is no need for the user to designate the expression sample Ea or the expression period Eb, or to configure the processing parameters Ec. Accordingly, it is possible to generate natural-sounding voices with voice expressions appropriately imparted thereto, without need for expertise on voice expressions or carrying out complex tasks in imparting voice expressions.

In the present embodiment, the expression sample Ea and the expression period Eb are specified by inputting the note data N to the first trained model M1, and processing parameters Ec are specified by inputting control data C including the expression sample Ea and the expression period Eb to the second trained model M2. Accordingly, it is possible to appropriately specify an expression sample Ea, an expression period Eb, and processing parameters Ec for unknown note data N. Further, the fundamental frequency Fx(t) and the spectrum envelope contour Gx(t) of the voice signal X are changed using an expression sample Ea, and hence, it is possible to generate a voice signal Z that represents a natural-sounding voice.

Modifications

Specific modifications added to each of the aspects described above are described below. Two or more modes selected from the following descriptions may be combined with one another in so far as no contradiction arises from such a combination.

(1) The note data N described above designate information on a note itself (a pitch, duration, and intensity) and information on relations of the note with other notes (e.g., a duration of an unvoiced period that precedes or follows the note, a difference in pitch between the note and a preceding note, and a difference in pitch between the note and a following note). However, information represented by the note data N is not limited to the above example. For example, the note data N may specify a performance speed of a song, or phonemes for a note (e.g., letters or characters of lyrics).

(2) In the above embodiment a configuration is described in which the specifying processor 20 includes the first specifier 21 and the second specifier 22. However, a configuration including separate elements for identifying an expression sample Ea and an expression period Eb by the first specifier 21 and for identifying processing parameters Ec by the second specifier 22 need not necessarily be employed. That is, the specifying processor 20 may specify an expression sample Ea, an expression period Eb, and processing parameters Ec by inputting the note data N to a trained model.

(3) In the above embodiment a configuration is described that includes the first specifier 21 for specifying an expression sample Ea and an expression period Eb and the second specifier 22 for specifying processing parameters Ec. However, one of the first specifier 21 and the second specifier 22 need not necessarily be provided. For example, in a configuration in which the first specifier 21 is not provided, a user may designate an expression sample Ea and an expression period Eb by way of an operation input to the input device 13. In a configuration in which the second specifier 22 is not provided, a user may designate processing parameters Ec by way of an operation input to the input device 13. As will be understood from the foregoing, the information processing apparatus 100 may be provided with only one of the first specifier 21 and the second specifier 22.

(4) In the above embodiment, it is determined whether to add voice expressions to a note according to the note data N. However, determination of whether to add voice expressions may be made by taking into account other information in addition to the note data N. For example, a configuration may be conceived in which no voice expressions are imparted when a degree of feature-variation amounts is large during the expression period Eb of the voice signal X, for example (i.e., sufficient voice expressions are imparted to the singing voice).

(5) In the above embodiment, voice expressions are imparted to a voice signal X representative of a singing voice. However, audio to which expression may be imparted is not limited to singing voices. For example, the present disclosure may be applied to imparting various expressions to a music performance sound produced by playing a musical instrument. That is, the expression imparting processing S3 is generally referred to as processing of imparting sound expressions (e.g., singing expressions or musical instrument playing expressions) to a portion that corresponds to an expression period within an audio signal representative of audio (e.g., voice signals or musical instrument sound signals).

(6) In the above embodiment, the processing parameters Ec including the extension or contraction rate R, the coefficients ax and ay, and the coefficients βx and βy are given as an example. However, a type or a total number of parameters included in the processing parameters Ec are not limited to the above example. For example, the second specifier 22 may specify one of the coefficients αx and αy, and may calculate the other one by subtracting the specified coefficient from 1. Similarly, the second specifier 22 may specify one of the coefficients βx and βy, and may calculate the other one by subtracting the specified coefficient from 1. In a configuration in which the extension or contraction rate R is fixed at a predetermined value, the extension or contraction rate R is excluded from the processing parameters Ec specified by the second specifier 22.

(7) Functions of the information processing apparatus 100 according to the above embodiment may be realized by a processor, such as the controller 11, working in coordination with a computer program stored in a memory, as described above. The computer program may be provided in a form readable by a computer and stored in a recording medium, and installed in the computer. The recording medium is, for example, a non-transitory recording medium. While an optical recording medium (an optical disk) such as a CD-ROM (compact disk read-only memory) is a preferred example of a recording medium, the recording medium may also include a recording medium of any known form, such as a semiconductor recording medium or a magnetic recording medium. The non-transitory recording medium includes any recording medium except for a transitory, propagating signal, and does not exclude a volatile recording medium. The non-transitory recording medium may be a storage apparatus in a distribution apparatus that stores a computer program for distribution via a communication network.

APPENDIX

The following configurations, for example, are derivable from the embodiments described above.

A computer-implemented sound processing method according to one aspect (first aspect) of the present disclosure obtains note data representative of a note; obtains an audio signal to be processed; specifies, in accordance with the note, an expression sample representative of a sound expression to be imparted to the note and an expression period, of the audio signal, to which the sound expression is to be imparted to the note; specifies, in accordance with the expression sample and the expression period, a processing parameter relating to an expression imparting processing for imparting the sound expression to a portion corresponding to the expression period of the audio signal; and generates a processed audio signal by performing the expression imparting processing in accordance with the expression sample, the expression period, and the processing parameter to the audio signal. According to the above aspect, since an expression sample and an expression period, and a processing parameter of the expression imparting processing are identified in accordance with note data, a user need not set the expression sample, the expression period, or the processing parameter. Accordingly, it is possible to generate natural-sounding audio with sound expressions appropriately imparted thereto, without need for expertise on sound expressions or carrying out complex tasks in imparting sound expressions.

In an example (second aspect) of the first aspect, the specifying of the expression sample and the expression period includes inputting the note data to a first trained model, to specify the expression sample and the expression period.

In an example (third aspect) of the second aspect, the specifying of the processing parameter includes inputting control data representative of the expression sample and the expression period to a second trained model, to specify the processing parameter.

In an example (fourth aspect) of any one of the first to the third aspects, the expression period of the audio signal comprises an attack portion that includes a start point of the note or a release portion that includes an end point of the note.

In an example (fifth aspect) of any one of the first to the fourth aspects, the expression imparting processing includes: changing, in accordance with (i) a fundamental frequency corresponding to the expression sample and (ii) the processing parameter, a fundamental frequency in the expression period of the audio signal; and changing, in accordance with (i) a spectrum envelope contour corresponding to the expression sample and (ii) the processing parameter, a spectrum envelope contour in the expression period of the audio signal.

A computer-implemented sound processing method according to one aspect (sixth aspect) of the present disclosure, obtains note data representative of a note; obtains an audio signal to be processed; obtains an expression sample representative of a sound expression; obtains an expression period, of the audio signal, to which the sound expression is to be imparted; specifies, in accordance with (i) the expression sample to be imparted to the note and (ii) the expression period to which the sound expression is to be imparted to the note, a processing parameter relating to an expression imparting processing for imparting the sound expression to a portion corresponding to the expression period of the audio signal; and generates a processed audio signal by performing the expression imparting processing in accordance with the processing parameter to the audio signal. According to the above aspect, since an expression sample and an expression period, and a processing parameter of the expression imparting processing are identified in accordance with note data, a user need not set the expression sample, the expression period, or the processing parameter. Accordingly, it is possible to generate natural-sounding audio with sound expressions appropriately imparted thereto, without need for expertise on sound expressions or carrying out complex tasks in imparting sound expressions.

A sound processing apparatus according to one aspect (seventh aspect) of the present disclosure includes a memory storing instructions; at least one processor that implements the instructions to: obtain note data representative of a note; obtain an audio signal to be processed; specify, in accordance with the note, an expression sample representative of a sound expression to be imparted to the note and an expression period, of the audio signal, to which the sound expression is to be imparted to the note; specify, in accordance with the expression sample and the expression period, a processing parameter relating to an expression imparting processing for imparting the sound expression to a portion corresponding to the expression period of the audio signal; and generate a processed audio signal by performing the expression imparting processing in accordance with the expression sample, the expression period, and the processing parameter to the audio signal. According to the above aspect, because an expression sample and an expression period, and a processing parameter of the expression imparting processing are identified in accordance with note data, a user need not set the expression sample, the expression period, or the processing parameter. Accordingly, it is possible to generate natural-sounding audio with sound expressions appropriately imparted thereto, without need for expertise on sound expressions or carrying out complex tasks in imparting sound expressions.

In an example (eighth aspect) of the seventh aspect, the at least one processor specifies the expression sample and the expression period by processing the note using a first trained model.

In an example (ninth aspect) of the eighth aspect, the at least one processor specifies the processing parameter by processing control data representative of the expression sample and the expression period using a second trained model.

In an example (tenth aspect) of any one of the seventh to the ninth aspects, the expression period of the audio signal comprises an attack portion that includes a start point of the note or a release portion that includes an end point of the note.

In an example (eleventh aspect) of any one of the seventh to the tenth aspects, the at least one processor performs the expression imparting processing, which: changes, in accordance with (i) a fundamental frequency corresponding to the expression sample and (ii) the processing parameter, a fundamental frequency of the audio signal in the expression period of the audio signal; and changes, in accordance with (i) a spectrum envelope contour corresponding to the expression sample and (ii) the processing parameter, a spectrum envelope contour of the audio signal in the expression period of the audio signal.

A sound processing apparatus according to one aspect (twelfth aspect) of the present disclosure includes a memory storing instructions; and at least one processor that implements the instructions to: obtain note data representative of a note; obtain an audio signal to be processed; obtain an expression sample representative of a sound expression; obtain an expression period, of the audio signal, to which the sound expression is to be imparted; specify, in accordance with (i) an expression sample to be imparted to the note and (ii) the expression period to which the sound expression is to be imparted to the note, a processing parameter relating to an expression imparting processing for imparting the sound expression to a portion corresponding to the expression period of the audio signal; and generate a processed audio signal by performing the expression imparting processing in accordance with the processing parameter to the audio signal. According to the above aspect, since an expression sample and an expression period, and a processing parameter of the expression imparting processing are identified in accordance with note data, a user need not set the expression sample, the expression period, or the processing parameter. Accordingly, it is possible to generate natural-sounding audio with sound expressions appropriately imparted thereto, without need for expertise on sound expressions or carrying out complex tasks in imparting sound expressions.

A computer-readable recording medium according to one aspect (thirteenth aspect) of the present disclosure stores a program executable by a computer to execute a sound processing method comprising: obtaining note data representative of a note; obtaining an audio signal to be processed; specifying, in accordance with the note, an expression sample representative of a sound expression to be imparted to the note and an expression period, of the audio signal, to which the sound expression is to be imparted to the note; specifying, in accordance with the expression sample and the expression period, a processing parameter relating to an expression imparting processing for imparting the sound expression to a portion corresponding to the expression period of the audio signal; and generating a processed audio signal by performing the expression imparting processing in accordance with the expression sample, the expression period, and the processing parameter to the audio signal. According to the above aspect, since an expression sample and an expression period, and a processing parameter of the expression imparting processing are identified in accordance with the note data, a user need not set the expression sample, the expression period, or the processing parameter. Accordingly, it is possible to generate natural-sounding audio with sound expressions appropriately imparted thereto, without need for expertise on sound expressions or carrying out complex tasks in imparting sound expressions.

BRIEF DESCRIPTION OF REFERENCE SIGNS

100 . . . information processing apparatus, 11 . . . controller, 12 . . . storage device, 13 . . . input device, 14 . . . sound output device, 20 . . . specifying processor, 21 . . . first specifier, 22 . . . second specifier, 30 . . . expression imparter.

What is claimed is:

1. A computer-implemented sound processing method comprising:

obtaining note data representing a note among a series of notes;

obtaining a voice signal to be processed;

inputting the note data to a first trained model, which has been generated by machine learning using first teacher data in which (i) teaching note data and (ii) a teaching expression sample and a teaching expression period have been associated with each other, to obtain:

an expression period during which a sound expression is to be imparted; and an expression sample representing the sound expression to be imparted during the expression period;

inputting control data, which includes the note data, the expression sample, and the expression period, to a second trained model, which has been generated by machine learning using second teacher data in which teaching control data and teaching processing parameters have been associated with each other, to obtain a processing parameter relating to an expression imparting processing for imparting the sound expression to a portion of the voice signal corresponding to the expression period; and generating a processed voice signal by performing the expression imparting processing, which includes extending or contracting the expression period of the expression sample, in accordance with the expression sample, the expression period, and the processing parameter to the portion of the voice signal and synthesizing the portion of the voice signal.

2. The computer-implemented sound processing method according to claim 1, further comprising:

determining whether to add a sound expression to the note, wherein the specifying of the expression sample and the expression period is performed for the note that has been determined to add the sound expression.

3. The computer-implemented sound processing method according to claim 1, wherein the expression period comprises an attack portion that includes a start point of the note or a release portion that includes an end point of the note.

4. The computer-implemented sound processing method according to claim 1, wherein the expression imparting processing further:

changes a fundamental frequency of the voice signal in the expression period in accordance with:

a fundamental frequency corresponding to the expression sample; and the processing parameter; and changes a spectrum envelope contour of the voice signal in the expression period in accordance with:

a spectrum envelope contour corresponding to the expression sample; and the processing parameter.

5. A sound processing apparatus comprising:

a memory storing instructions;

at least one processor that implements the instructions to:

obtain note data representing a note among a series of notes;

obtain a voice signal to be processed;

inputting the note data to a first trained model, which has been generated by machine learning using first teacher data in which (i) teaching note data and (ii) a teaching expression sample and a teaching expression period have been associated with each other, to obtain:

an expression period during which a sound expression is to be imparted; and an expression sample representing the sound expression to be imparted during the expression period;

inputting control data, which includes the note data, the expression sample, and the expression period, to a second trained model, which has been generated by machine learning using second teacher data in which teaching control data and teaching processing parameters have been associated with each other, to obtain a processing parameter relating to an expression imparting processing for imparting the sound expression to a portion of the voice signal corresponding to the expression period; and generate a processed voice signal by performing the expression imparting processing, which includes extending or contracting the expression period of the expression sample, in accordance with the expression sample, the expression period, and the processing parameter to the portion of the signal and synthesize the portion of the voice signal.

6. The sound processing apparatus according to claim 5, wherein:

the at least one processor further determines whether to add a sound expression to the note, and the at least one processor specifies the expression sample and the expression period for the note that has been determined to add the sound expression.

7. The sound processing apparatus according to claim 5, wherein the expression period comprises an attack portion that includes a start point of the note or a release portion that includes an end point of the note.

8. The sound processing apparatus according to claim 5, wherein the at least one processor further performs the expression imparting processing that:

changes a fundamental frequency of the voice signal in the expression period in accordance with:

a fundamental frequency corresponding to the expression sample; and the processing parameter; and changes a spectrum envelope contour of the voice signal in the expression period, in accordance with:

a spectrum envelope contour corresponding to the expression sample; and the processing parameter.

9. A non-transitory computer-readable recording medium storing a program executable by a computer to execute a sound processing method comprising:

obtaining note data representing a note among a series of notes;

obtaining a voice signal to be processed;

inputting the note data to a first trained model, which has been generated by machine learning using first teacher data in which (i) teaching note data and (ii) a teaching expression sample and a teaching expression period have been associated with each other, to obtain:

an expression period during which a sound expression is to be imparted; and an expression sample representing the sound expression to be imparted during the expression period;

inputting control data, which includes the note data, the expression sample, and the expression period, to a second trained model, which has been generated by machine learning using second teacher data in which teaching control data and teaching processing parameters have been associated with each other, to obtain a processing parameter relating to an expression imparting processing for imparting the sound expression to a portion of the voice signal corresponding to the expression period; and generating a processed voice signal by performing the expression imparting processing, which includes extending or contracting the expression period of the expression sample, in accordance with the expression sample, the expression period, and the processing parameter to the portion of the voice signal and synthesizing the portion of the voice signal.

10. The computer-implemented sound processing method according to claim 1, wherein the voice signal has been generated based on the note data.

11. The computer-implemented sound processing method according to claim 1, wherein the expression sample is specified from a plurality of expression samples corresponding to different types of sound expressions.

12. The computer-implemented sound processing method according to claim 1, wherein the first teacher data used for training the first trained model further includes portions in which the note data is associated with data indicating that no voice expression is to be imparted.

13. The sound processing apparatus according to claim 5, wherein the first teacher data used for training the first trained model includes portions in which the note data are associated with data indicating that no voice expressions are to be imparted.

* * * * *